US010315301B2

(12) United States Patent
Huang et al.

(10) Patent No.: US 10,315,301 B2
(45) Date of Patent: Jun. 11, 2019

(54) ELECTRIC POWER TOOL

(71) Applicant: NINGBO HAILIAN ELECTRIC APPLIANCE CO., LTD., Ningbo (CN)

(72) Inventors: Yonglin Huang, Ningbo (CN); Yuecun He, Ningbo (CN)

(73) Assignee: NINGBO HAILIAN ELECTRIC APPLIANCE CO., LTD., Ningbo (CN)

( * ) Notice: Subject to any disclaimer, the term of this patent is extended or adjusted under 35 U.S.C. 154(b) by 388 days.

(21) Appl. No.: 15/105,574

(22) PCT Filed: Jan. 22, 2014

(86) PCT No.: PCT/CN2014/071102
§ 371 (c)(1),
(2) Date: Jun. 17, 2016

(87) PCT Pub. No.: WO2014/146512
PCT Pub. Date: Sep. 25, 2014

(65) Prior Publication Data

US 2016/0318169 A1 Nov. 3, 2016

(51) Int. Cl.
*B25F 5/02* (2006.01)
*B25F 5/00* (2006.01)
*B25B 21/00* (2006.01)

(52) U.S. Cl.
CPC ..... *B25F 5/029* (2013.01); *B25B 21/00* (2013.01); *B25F 5/001* (2013.01)

(58) Field of Classification Search
CPC .. B25F 5/029; B25F 5/001; B25F 1/04; B25F 5/02; B25B 21/00; B25B 23/06;
(Continued)

(56) References Cited

U.S. PATENT DOCUMENTS 4,772,765 A * 9/1988 Markle ..... H01H 9/063 200/1 V
4,976,175 A * 12/1990 Hung ..... B25F 5/029 81/177.5

(Continued)

FOREIGN PATENT DOCUMENTS

CN 201913273 U 8/2011
CN 103269834 A 8/2013

(Continued)

*Primary Examiner* — Alexander M Valvis
*Assistant Examiner* — Mobeen Ahmed
(74) *Attorney, Agent, or Firm* — Gokalp Bayramoglu

(57) ABSTRACT

The present invention provides a structurally simple, compact, energy-saving electric power tool having a long service life, the tool including a motor, a gearbox, a cutter library and a cutter holder; the motor is connected with an input member of the gearbox; it further includes a first case and a second case; the motor and the gearbox are disposed within the first case; the cutter library and the cutter holder are disposed within the second case; the cutter library and the cutter holder are both rotatablely connected with the second case; the first case and the second case are axially movable so that an output member of the gearbox can be sequentially sleeved to a cutter hole 8 of the cutter library and the cutter holder, or can be separated in the opposite direction.

7 Claims, 4 Drawing Sheets

(58) Field of Classification Search
CPC ..... Y10T 408/37; Y10T 483/1798; Y10T 483/1783; Y10T 483/1827; Y10T 483/1748; B25G 1/08; B23Q 3/15526; B23Q 3/15706; B23Q 3/1574
See application file for complete search history.

(56) References Cited

U.S. PATENT DOCUMENTS 5,065,498 A * 11/1991 McKenzie ..... B23Q 3/15526 408/35
5,597,275 A * 1/1997 Hogan ..... B23B 31/005 279/89
6,007,277 A * 12/1999 Olson ..... B25F 5/029 408/124
6,928,908 B1 * 8/2005 Yu ..... B25B 15/04 81/177.4
7,237,458 B2 * 7/2007 Shiao ..... B25B 13/463 81/62
9,427,861 B2 * 8/2016 Reynolds ..... B25G 1/085
9,662,716 B2 * 5/2017 Liu ..... B23B 45/001
2009/0298658 A1 * 12/2009 Yeh ..... B23Q 3/15766 483/57
2010/0279839 A1 * 11/2010 Moser ..... B25B 21/00 483/36
2012/0090434 A1 * 4/2012 Chen ..... B25B 15/04 81/60
2013/0032368 A1 * 2/2013 Zhang ..... B25F 5/029 173/1
2013/0244845 A1 * 9/2013 Nagy ..... B25F 5/029 483/12
2014/0329654 A1 * 11/2014 Andriolo ..... B25F 5/029 483/1
2015/0021061 A1 * 1/2015 Nagy ..... B25F 5/029 173/29
2016/0339579 A1 * 11/2016 Pham ..... B25B 23/12

FOREIGN PATENT DOCUMENTS

CN 103862436 A 6/2014
CN 203665476 U 6/2014
GB 2212428 A 7/1989
JP H10113805 A 5/1998
WO WO2011017794 A1 2/2011

* cited by examiner

ELECTRIC POWER TOOL

TECHNICAL FIELD

This invention relates to a tool, more specifically, to an electric power tool.

BACKGROUND

There is an electronic power tool currently existed in the market, which includes a motor, a gearbox, a pushrod for extending and retracting a cutter, a cutter library, a cutter holder; the motor is connected with an input member of the gearbox; an output member of the gearbox is connected with the pushrod; after an end of the pushrod entered the cutter holder, the pushrod drives the cutter holder to rotate; alternatively, the output member of the gearbox is connected with the cutter holder, and the output member drives the cutter holder to rotate. No matter which mechanism is chosen, in general, a first gear is set on the output member while a second gear is set on the pushrod or the cutter holder, and the fist gear engages with the second gear to reach the connection. Consequently, the output member is not coaxial with the cutter holder. Moreover, the space is needed to set up the pushrod. As a result, the electric power tool would be large in circumferential size, complicated in structure, and not compact enough. In order to push the cutter into the cutter holder, the pushrod is capable of moving axially and there are two available positions. Position One: the pushrod is retracted and therefore brings the cutter that located in the cutter holder to be stored in the cutter library; at this time, the cutter library is rotatable, and users can turn the cutter library to select a cutter; after selected, the pushrod extends forward to push the cutter into the cutter holder, which is the Position Two. The structure would be quite complicated as the structure should be designed to fit the axial movement of the pushrod. At the same time, when the cutter holder is rotating, the pushrod should also be rotating accordingly, which consumes considerable energy. The other end of the pushrod is generally connected with a sliding base, and the pushrod is rotatable relative to the sliding base. Consequently, the other end of the pushrod and the sliding base would be worn out because of the relative rotation, which would shorten the service life of the electronic power tool.

SUMMARY OF THE INVENTION

The technical problem that this invention aims to solve is to overcome the deficiency existed in the current technology, and provide an electronic power tool with a simple and compact structure, energy efficiency, and long service life.

In order to solve the above-mentioned technical problem, this invention provides an electric power tool, including: a motor, a gearbox, a cutter library, a cutter holder; the motor is connected with an input member with the gearbox; the electric power tool further includes a first case and a second case; the motor and the gearbox are located within the first case; the cutter library and the cutter holder are disposed within the second case; the cutter library and the cutter holder are both rotatably connected with the second case; the first case and the second case are capable of axially moving so that the output member of the gearbox can be sequentially sleeved to a cutter hole of the cutter library and the cutter holder, or can be separated in the opposite direction. The sleeve connection between the output member and the cutter holder means that the output member is circumferentially sleeve-connected to the cutter holder in a transmittable way; a structure for users to drive the cutter library is set on the second case: the output member, the cutter hole, and the cutter holder are located on a same axis.

The working principle of this invention is illustrated as follows: the first case and the second case can conduct relatively axial movement to determine two positions. Position One, the second case moves forward, and the output member is retracted from the cutter holder and the cutter hole in a sequence so as to bring back the cutter to the cutter library; when the retracting is in place, the cutter library would be released from the circumferential limit of the output member, and consequently the cutter library can be rotated. Position Two, the second case is repositioned by moving backward, and the output member is extended into the cutter hole and the cutter holder in a sequence, so as to push the cutter into the cutter holder; when the pushing is in place, the output member and the cutter holder are circumferentially sleeve-connected in a transmittable way so that the output member can transmit torsion to rotate the cutter holder, and the cutter holder in turn drives the rotating of the cutter.

By adopting the abovementioned structure, this invention has the following advantages: due to the absence of a pushrod, the output member functions as the pushrod. Moreover, the first gear and the second gear existed in the current technology are not necessary now. Furthermore, the output member of the gearbox, one of the cutter holes of the cutter library and the cutter holder are located on a same axis. Therefore, this invention has the advantages of a simple and compact structure, energy efficiency, and long service life.

As an improvement, the gearbox is an epicyclic gear train gearbox. Thus, the axis of the epicyclic gear train gearbox is the axis where the output member is located, so that the epicyclic gear train gearbox, the cutter hole and the cutter holder are located on a same axis. This invention has a simple and compact structure and light weight, and can work in a more steady and reliable way. As a result, the circumferential size of this invention is reduced.

As an improvement, the motor, the output member, the cutter hole and the cutter holder are located on a same axis. Thus, it has more advantage to improve the compactness of the circumferential space layout.

As an improvement, a positioning mechanism is disposed between the first case and the second case so as to determine whether the output member is retracted in place and whether the output member is extended in place. Thus, a certain axial limit is generated on Position One and Position Two, so that the first case and the second case would not move by mistake in axial direction.

As an improvement, the positioning mechanism refers to as follows: along the axial direction, a first radial notch and a second radial notch are disposed on the second case; a sphere radially supported by a flexible member is disposed on the first case; and the sphere is located on the front part of the first case. Such a simple, compact and lightweight structure, reliable positioning, and steady work condition can improve the performance of this invention.

As an improvement, the first case and the second case are axially movably connected with each other is illustrated as follows: the first case is used as a pillar, while the second case is used as a hole; the pillar and the hole are movably sleeved together. Such a simple and compact and lightweight structure, reliable positioning, and steady work condition can improve the performance of this invention.

As an improvement, the first case and the second case are axially movably connected with each other further includes a guiding mechanism. The guiding mechanism includes at least one axially disposed guiding rod set on the case body of the gearbox, a guiding sleeve disposed on the second case; the guiding rod and the guiding sleeve are movably sleeved together. Thus, it can enhance the stability of the axial movement, and make the axial movement of the first case and the second case be more steady and reliable. At the same time, the circumferential connection between the first case and the second case is also strengthened. In other words, the second case has a better circumferential stability.

As an improvement, the structure for users to drive the cutter library disposed on the second case is illustrated as follows: an opening is disposed on the second case for users to turn the cutter library. Thus, the structure can be simple, compact and lightweight so that the performance of this invention can be improved.

As an improvement, the rotatable connection between the cutter holder and the second case is illustrated as follows: a bearing is disposed on the second case, and the cutter holder is connected with the bearing. Thus, the structure is steady and reliable so that the performance of this invention can be improved.

As an improvement, the circumferential sleeve-connection in a transmittable way between the output member and the cutter holder is illustrated as follows: the output member is a polygonal shaft; a polygonal hole engaged with the polygonal shaft is set on the cutter holder; and the polygonal shaft is sleeve-connected with the polygonal hole. Thus, the simple structure, steady and reliable transmission, and light weight can improve the capacity of the circumferential space layout of this invention.

Figure 1:
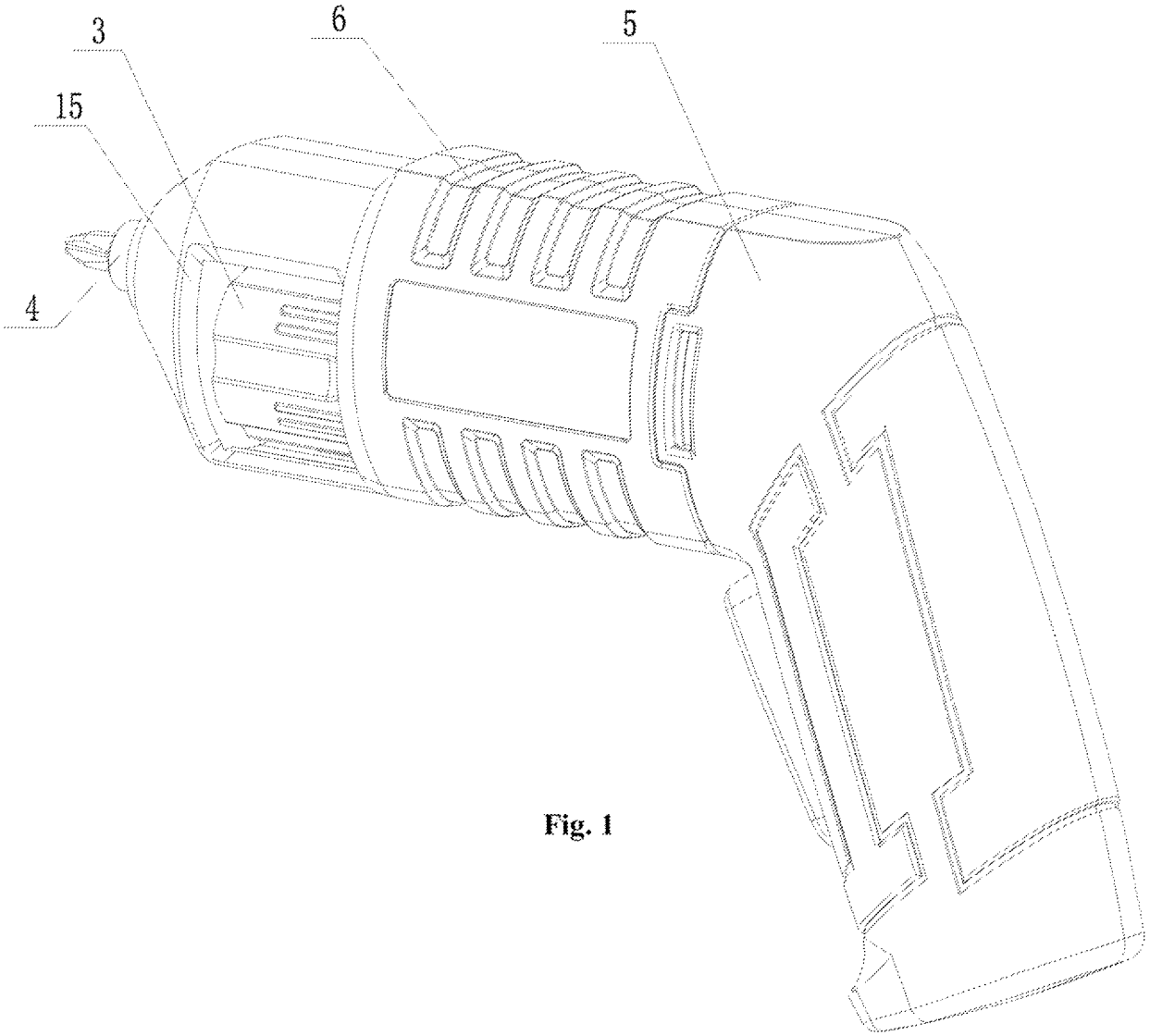
FIG. 1 is a schematic diagram of the electronic power tool of this invention with Position One.
Figure 2:
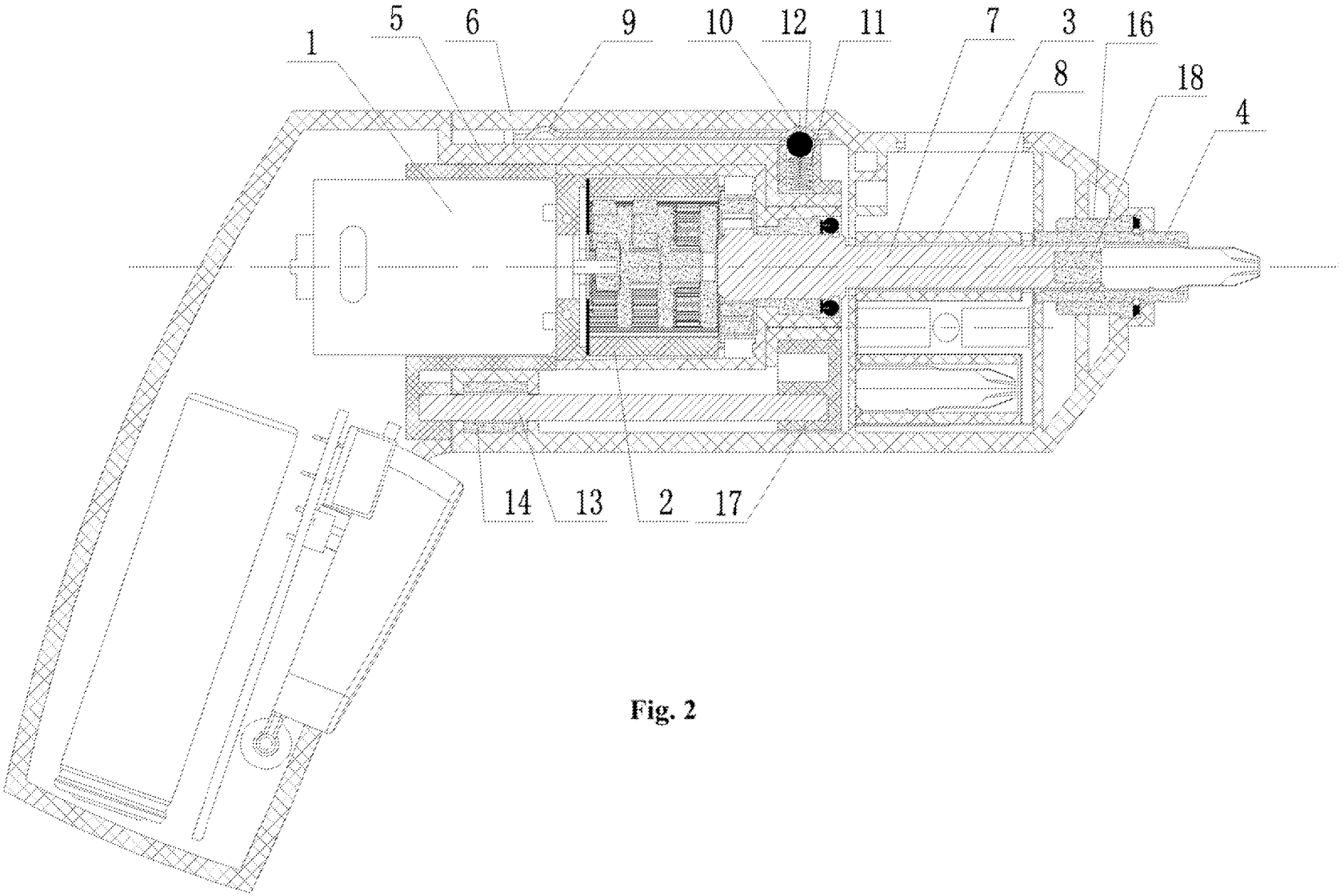
FIG. 2 is a section view of FIG. 1.
Figure 3:
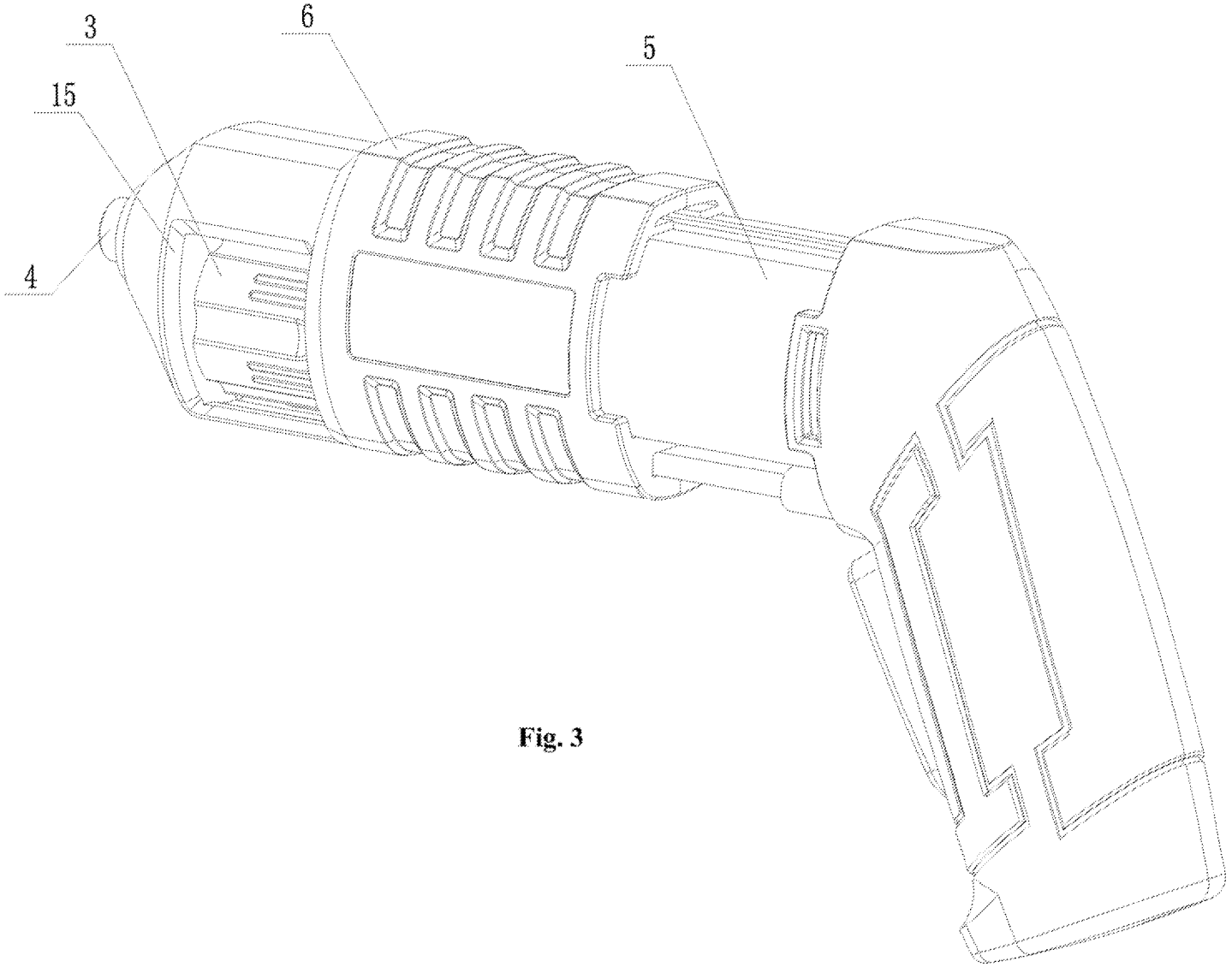
FIG. 3 is a schematic diagram of the electronic power tool of this invention with Position Two.

As shown in the figures: 1. Motor; 2. Gearbox; 3. Cutter library; 4. Cutter holder; 5. First case; 6. Second case; 7. Output member; 8. Cutter hole; 9. First radial notch; 10. Second radial notch; 11. Flexible member; 12. Sphere; 13. Guiding rod; 14. Guiding sleeve; 15. Opening; 16. Bearing; 17. Guiding rod fixing base; 18. Magnet.

DETAILED DESCRIPTION OF THE INVENTION

Hereinafter, this invention will be further described in conjunction with the accompanying figures and embodiments:

An electronic power tool includes: a motor 1, a gearbox 2, a cutter library 3 and a cutter holder 4; the motor 1 is connected with an input member of the gearbox 2; it further includes a first case 5 and a second case 6; motor 1 and gearbox 2 are disposed within the first case 5; the cutter library 3 and the cutter holder 4 are disposed within the second case 6; the cutter library 3 and the cutter holder 4 are both rotatably connected with the second case 6; the first case 5 and the second case 6 are capable of axially moving so that the output member 7 of gearbox 2 can be sequentially sleeved to a cutter hole 8 of the cutter library 3 and the cutter holder 4, or can be separated in the opposite direction. The sleeve connection between the output member 7 and the cutter holder 4 means that the output member is circumferentially sleeve-connected with the cutter holder 4 in a transmittable way. A structure for users to drive the cutter library 3 is set on the second case 6, specifically, the output member 7, the cutter hole 8, the cutter holder 4 are located on a same axis; the cutter library 3, the cutter holder 4 are axially moved together with the second case 6 to determine two positions. Position One, the second case 6 moves forward, the output member 7 is retracted from the cutter holder 4 and the cutter hole 8 in a sequence so as to bring back the cutter to the cutter library 3; when the retracting is in place, the cutter library 3 can be rotated relative to the second case 6. Position Two, the second case 6 is repositioned by moving backward, the output member 7 is extended into the cutter hole 8 and the cutter holder 4 in a sequence so as to push the cutter into the cutter holder 4; when the extending is in place, the output member 7 and the cutter holder 4 are connected so that the output member 7 can drive the cutter holder 4 to rotate.

Gearbox 2 is an epicyclic gear train gearbox. Output member 7 is connected with a planetary carrier of the epicyclic gear train gearbox; the specific structure of the output member 7 is an output shaft.

The motor 1, output member 7, the cutter hole 8 and the cutter holder 4 are located on a same axis.

A positioning mechanism is disposed between the first case 5 and the second case 7, so as to determine whether the output member 7 is retracted in place and whether the output member 7 is extended in place.

The positioning mechanism refers to a structure as follows: along the axial direction, the first radial notch 9 and the second radial notch 10 are disposed on the second case 6; a sphere 12 radially supported by the flexible member 11 is disposed on the first case 5; and the sphere 12 is located at the front part of the first case 5.

The first case 5 and the second case 6 are axially movably connected with each other, specifically, the first case 5 is used as a pillar, and second case 6 is used as a hole; and the pillar and the hole are movably sleeved together.

The axially movable connection between the first case 5 and the second case 6 further includes a guiding mechanism. The guiding mechanism includes at least one axially disposed guiding rod 13 set on the case body of the gearbox 2, and a guiding sleeve 14 disposed on the second case 6; wherein the guiding rod 13 and the guiding sleeve 14 are axially movably sleeved together.

The structure for users to drive the cutter library 3 disposed on the second case 6, specifically, the opening 15 is disposed on the second case 6 for users to turn the cutter library 3.

The cutter holder 4 and the second case 6 are rotatably connected with each other, specifically, a bearing 16 is disposed on the second case 6, and the cutter holder 4 is connected with the bearing 16.

The Bearing 16 can be a shaft sleeve, a ball bearing 16 or a thrust-bearing 16.

The output member 7 and the cutter holder 4 is circumferentially sleeve-connected in a transmittable way, specifically, the output member 7 is a polygonal shaft; a polygonal hole engaged with the polygonal shaft is set on the cutter holder 4; and the polygonal shaft is sleeve-connected with the polygonal hole.

The polygonal shaft is a hexagon shaft, and the polygonal hole is a hexagon hole.

In this embodiment, there are two guiding rods 13, and both of them are located at the bottom of the case body of the gearbox 2. The axially movable connection between the first case 5 and the second case 6 can also only include the guiding structure, and the axially moveable sleeve-connection between the pillar and the hole is optional. It is changeable for the structure of the axially movable connection between the first case 5 and the second case 6. For easy installation, the electronic power tool further includes a guiding rod fixing base 17, and it can be used in the following condition. Specifically, after one end of the guiding rod 13 sleeved into the guiding sleeve 14 is installed on an installing base set on the gearbox, the guiding rod fixing base 17 is sleeved into another end of the guiding rod 13 from the another end of the guiding rod 13. At this time, an axial opening on a guiding rod fixing base 17 is sleeve-connected with the front part of the first case 5. The front part extends out with an output member 7 to circumferentially lock the two symmetric parts which forms the first case 5, at the front part of first case 5, so as to finish the assembling of the two symmetric parts. The assembling contributes to form the first case 5, and at the same time makes the output member 7 pass through the guiding rod fixing base 17. In addition, an installing opening is set on the guiding rod fixing base 17 for installing flexible member 11. The design of guiding rod fixing base 17 makes the electronic power tool more simple and compact, and more steady and reliable. A guiding sleeve 14 is connected with the second case 6, as a structure illustrated in this embodiment, the second case 6 is also composed of two symmetric parts similar to the first case 5, except that a limit cavity for containing guiding sleeve 14 is formed after the two symmetric parts are constructed. Such structure is not only simple and reliable, but also has a light weight. There are two openings 15, which are respectively located at the left and right sides of the second case 6. A magnet 18 is set at the end part of the output member 7; and the magnet 18 is used to attract the cutter so that the magnet 18 can be brought back to the cutter library 3 when the output member 7 is retracted. The cutter can also easily be free from the magnet 18 when the cutter library 3 is rotating. Obviously, other structure that can realize the similar function as above can also be applied, such as grip-release structure, namely, it is changeable for the structure to bring back the cutter to cutter library 3 by the output member 7. The motor 1, the output member 7 of the gearbox 2, a cutter hole 8 of the cutter library 3, and the cutter holder 4 are located on a same axis. Thus, this electronic power tool can be more simple, compact, steady and reliable. The gearbox 2 itself can also be designed in a more simple, compact, steady and reliable way. An observation window is set right above the cutter library 3 of the second case 6 for facilitating the users to observe the rotating position of the cutter library 3.

Figure 4:
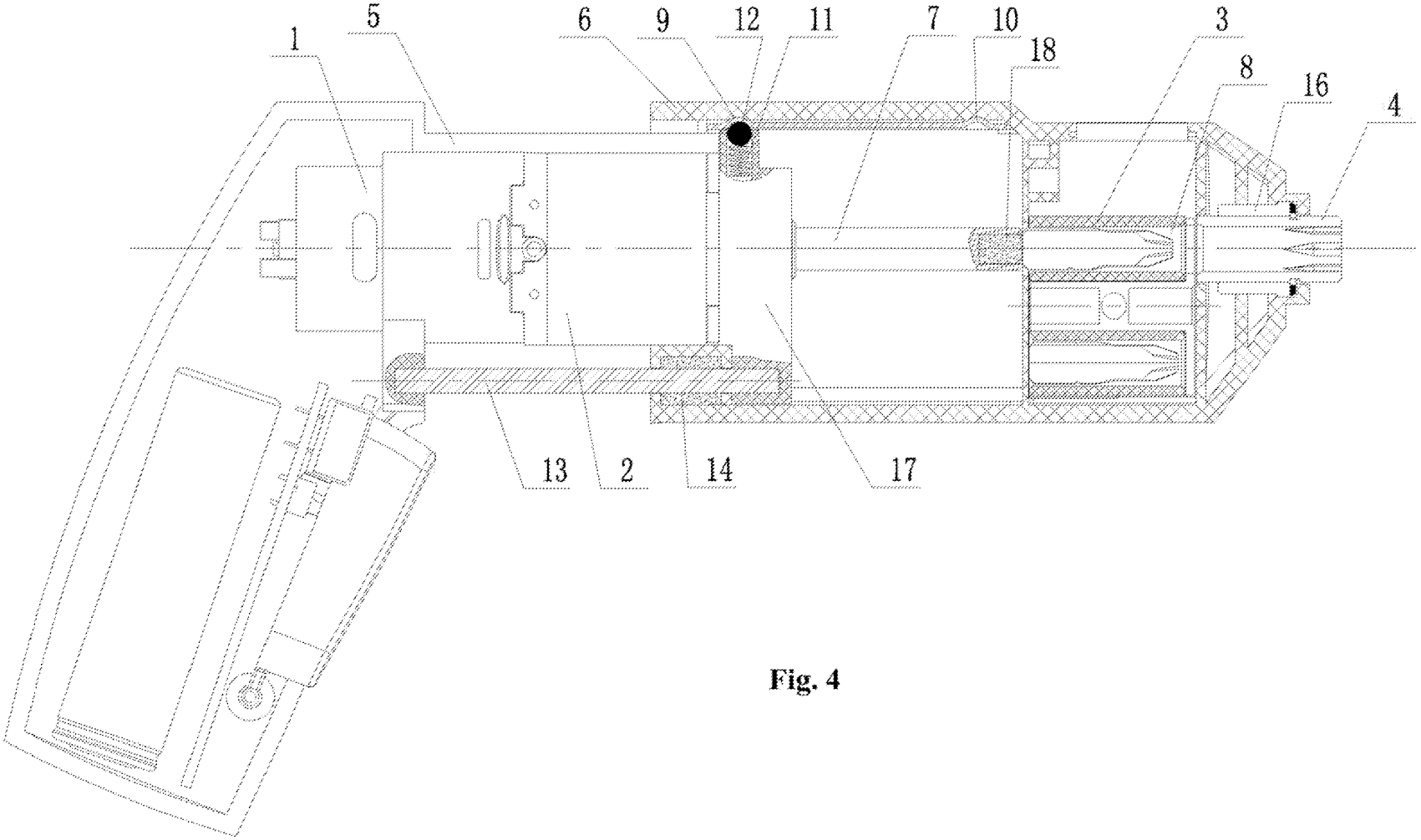
FIG. 4 is a section view of FIG. 3.

In FIG. 4, the sectional view of the output member 7 of the gearbox 2, the installing base, the guiding rod fixing base 17. In order to clearly distinguish between the first case 5 and the second case 6, the second case 6 is drawn with grid lines.

The invention claimed is:

1. An electronic power tool, comprising: a motor, a gearbox, a cutter library, and a cutter holder; the motor being connected with an input member of the gearbox; the tool further includes a first case and a second case; the motor and the gearbox are disposed within the first case; the cutter library and the cutter holder are disposed within the second case; the cutter library and the cutter holder are both rotatably connected with the second case; the first case and the second case are axially movable so that an output member of the gearbox is sequentially sleeved to a cutter hole of the cutter library and to the cutter holder; a sleeve connection between the output member and the cutter holder means that the output member is circumferentially sleeve-connected with the cutter holder in a transmittable way; an opening disposed on the second case for users to turn the cutter library; the output member, the cutter hole and the cutter holder are located coaxially; wherein an axially movable connection between the first case and the second case means that: the first case is used as a pillar, and the second case is used as a hole; and the pillar and the hole are movably sleeved together; wherein the axially movable connection between the first case and the second case further includes a guiding mechanism; the guiding mechanism includes at least one axially disposed guiding rod set on a case body of the gearbox and is located within both the first case and the second case and a guiding sleeve disposed on the second case; wherein the guiding rod and the guiding sleeve are movably sleeved together.

2. The electronic power tool according to claim 1, wherein, the gearbox is an epicyclic gear train gearbox.

3. The electronic power tool according to claim 1, wherein, the motor, the output member, and the cutter hole and the cutter holder are located on a same axis.

4. The electronic power tool according to claim 1, wherein, a positioning mechanism is disposed between the first case and the second case, so as to determine whether the output member is retracted in place and whether the output member is extended in place.

5. The electronic power tool according to claim 4, wherein the positioning mechanism further includes a first radial notch and a second radial notch, which are disposed on the second case along the axial direction, and a sphere radially supported by a flexible member, wherein the sphere is disposed on the first case and located on the front part of the first case.

6. The electronic power tool according to claim 1, wherein a rotatable connection between the cutter holder and the second case means that: a bearing is disposed on the second case, and the cutter holder is connected with the bearing.

7. The electronic power tool according to claim 1, wherein a circumferential sleeve-connection in a transmittable way between the output member and the cutter holder means that: the output member is a polygonal shaft; a polygonal hole engaged with the polygonal shaft is set on the cutter holder; the polygonal shaft is sleeve-connected with the polygonal hole.

* * * * *